US005822796A

United States Patent [19]

Harges, Jr. et al.

[11] Patent Number: 5,822,796

[45] Date of Patent: Oct. 20, 1998

[54] FIREFIGHTER GLOVE

[76] Inventors: Cordell Frank Harges, Jr., 12629 Loma Verde Dr., Victorville, Calif. 92392; Bert Rivera, 1707 S. Marengo Ave., Alhambra, Calif. 91803

[21] Appl. No.: 807,399

[22] Filed: Feb. 27, 1997

[51] Int. Cl.[6] ..... A41D 19/00

[52] U.S. Cl. ..... 2/161.6; 2/159

[58] Field of Search ..... 2/161.6, 159, 161.7, 2/162, 164, 167, 169

[56] References Cited

U.S. PATENT DOCUMENTS

| | | | |
|---|---|---|---|
| 1,437,318 | 11/1922 | Kyle | 2/161.6 |
| 1,537,429 | 5/1925 | Frankenstein et al. | 2/161.6 |
| 2,448,697 | 9/1948 | Bakke . | |
| 2,650,365 | 9/1953 | Singer . | |
| 2,837,745 | 6/1958 | Nelson . | |
| 3,416,158 | 12/1968 | Kulman . | |
| 3,548,413 | 12/1970 | Jackson . | |
| 3,822,417 | 7/1974 | Lars-Jos | 2/169 |
| 3,889,297 | 6/1975 | Jarboe et al. . | |
| 4,000,524 | 1/1977 | Rinehart | 2/161.6 |
| 4,032,990 | 7/1977 | Mandlman . | |
| 4,131,952 | 1/1979 | Brenning, Jr. . | |
| 4,302,851 | 12/1981 | Adair . | |
| 4,433,439 | 2/1984 | Sidman et al. | 2/161.6 |
| 4,441,213 | 4/1984 | Trumble et al. | 2/161.6 |
| 4,445,232 | 5/1984 | Nelson | 2/161.6 |
| 4,454,611 | 6/1984 | Tschirch et al. . | |
| 4,494,249 | 1/1985 | Hansson | 2/161.6 |
| 4,847,918 | 7/1989 | Sturm . | |
| 5,153,055 | 10/1992 | Ko . | |
| 5,163,183 | 11/1992 | Smith | 2/81 |
| 5,172,426 | 12/1992 | Capello . | |
| 5,349,705 | 9/1994 | Ragan | 2/161.6 |
| 5,369,806 | 12/1994 | Chan . | |
| 5,598,582 | 2/1997 | Andrews et al. | 2/161.6 |

OTHER PUBLICATIONS

*Health & Safety*, vol. 8, issue 5, May 1997, p. 8.

*Primary Examiner*—Gloria M. Hale
*Attorney, Agent, or Firm*—Rothwell, Figg, Ernst & Kurz

[57] ABSTRACT

A protective glove for use in fighting wildland fires has a relatively thin portion which protects the palm surface of the hand and a thick, padded, fire- and thermally-protective upper portion which protects the vulnerable skin on the back of the hand. The top portion includes joints which allow the fingers to be flexed. The configuration provides the firefighter with the dexterity required to fight a wildland fire and the level of protection necessary to avoid serious injury to the backs of the hands.

14 Claims, 5 Drawing Sheets

FIREFIGHTER GLOVE

In general, the invention relates to protective gloves for firefighters and, in particular, to gloves for wildland firefighting.

BACKGROUND OF THE INVENTION

When fighting fires, firefighters typically are exposed to extreme heat and direct contact with flame. Of the various parts of the body, the hands are one of the most important to protect from these conditions in view of the number of and nature of tasks a person performs every day using his or her hands. Gloves currently available for use in fighting wildland fires, however, have proven to be woefully deficient in terms of the protection they afford.

When fighting wildland fires, a firefighter relies on manual dexterity to advance hose over rocky and/or woody terrain; to manipulate tools such as spades, rakes, and hoes; to light backfire flares; to climb over rocks and fences; etc. Therefore, the thick, highly protective gloves which typically are used for structural firefighting (i.e., fighting building fires)—which are relatively cumbersome but provide sufficient dexterity for structural firefighting—are shunned in favor of substantially more flexible but far less protective gloves.

In particular, the type of glove most commonly used for fighting wildland fires is a simple suede or leather glove similar to the type typically used for gardening. Although they are flexible, such gloves provide very little thermal protection, especially for the backs of the hands where the skin is relatively thin and where severe burn injuries frequently pose great difficulties for treatment. (Recent stories, for example, have reported on a firefighter whose hand was so badly burned that it had to be inserted for a period of time into a pocket cut into the abdominal skin in order for skin cells to take to and grow on his hand. As explained by the doctor who performed the surgery, Dr. Richard Grossman, M.D., F.A.C.S., of the Grossman Burn Institute in Sherman Oaks, Calif. burn injuries to the joints are particularly difficult to treat in that they present a "Catch-22" situation: the joints must be manipulated in order to prevent formation of hard, tough scar tissue, yet the skin needs to be kept still in order for new skin cells to attach to and replace the injured skin.) Moreover, although such gloves typically have a fire resistant wrist gauntlet (extended cuff) that is made, for example, from a knit or woven PBI® and/or Kevlar® and/or Nomex® material, the knit or woven nature of the gauntlet allows the firefighter's wrists to be burned through the interstices of the fabric.

(As used throughout this application, the terms "fire resistant" and "fire resistance" shall be construed to refer to both flame resistance and inherent flame resistance as defined by the national Fire Protection Association (NFPA). According to the NFPA's Standard on Protective Ensembles and Fire Shelters for Wildland Firefighting, NFPA Std. #1977 (1998 version), flame resistance is the property of a material whereby combustion is prevented, terminated, or inhibited following the application of a flaming or nonflaming source of ignition, with or without subsequent removal of the ignition source. Flame resistance can be an inherent property of a material, or it can be imparted by specific treatment.

Inherent flame resistance is defined as "flame resistance that is derived from the essential characteristics of the fiber or polymer.")

Accordingly, there is need for a protective glove that provides the thermal/flame protection of a structural firefighting glove, especially to the backs of the hands, as well as the increased dexterity required when fighting a wildland fire.

SUMMARY OF THE INVENTION

The wildland firefighting glove of the present invention satisfies this need. Thus, a glove according to the invention has a bottom portion shaped to extend along the palm and bottom finger surfaces of a firefighter's hand and an upper portion shaped to extend along the back and upper finger surfaces of the firefighter's hand. The bottom portion includes a relatively thin, rugged, flexible outer layer which does not hamper the firefighter's manual dexterity, and the upper portion includes an outer shell formed from a fire resistant material and a thermally protective layer of insulative padding. With this configuration, the glove provides thermal and flame protection to the back of the firefighter's hand, thereby guarding against burn injuries, while permitting the level of manual dexterity necessary for fighting wildland fires.

Embodiments of the invention may include one or more of the following features. The bottom portion may further have a fire resistant, insulative inner layer, and the bottom portion may be formed from either animal hide or a synthetic material. The upper portion of the glove may include joints which allow the fingers of the firefighter's hand to be flexed, and the joints may be formed as accordion-type folds or stitching to "pre-shape" the fingers of the glove into a longitudinally curved configuration. Preferably, the upper portion covers the sides of the firefighter's fingers and has an internal fire resistant, insulative layer. The glove also preferably includes a padded wrist cuff formed from a fire resistant outer shell and a layer of fire resistant, insulative padding, as well as an extended wrist gauntlet formed from fire resistant material.

With a glove according to the invention, a firefighter has the manual dexterity necessary to fight a wildland fire effectively. In the event of intense exposure to heat or flame, the firefighter makes a fist or turns his or her hand into his or her body or tool. In that situation, the glove acts like the outer hide of an armadillo with the thick, top portion of the glove being exposed to the heat and protecting the more delicate skin on the top or back portion of the hand.

BRIEF DESCRIPTION OF THE DRAWINGS

The invention will now be described in more detail in connection with the drawings, in which.

DESCRIPTION OF PREFERRED EMBODIMENTS

Figure 1:
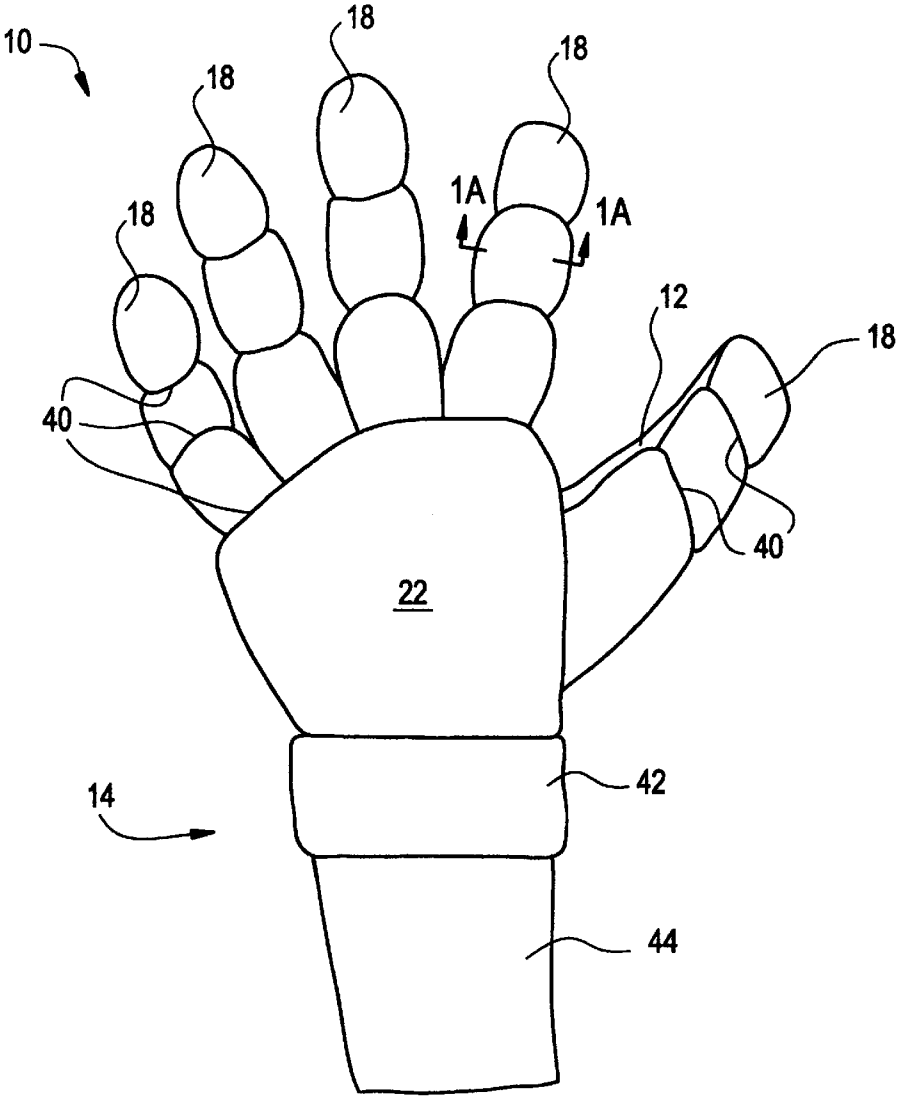
FIGS. 1, 2, and 3 are a top view (back-of-the-hand), bottom view (palm), and side view of a glove according to the invention.
Figure 2:
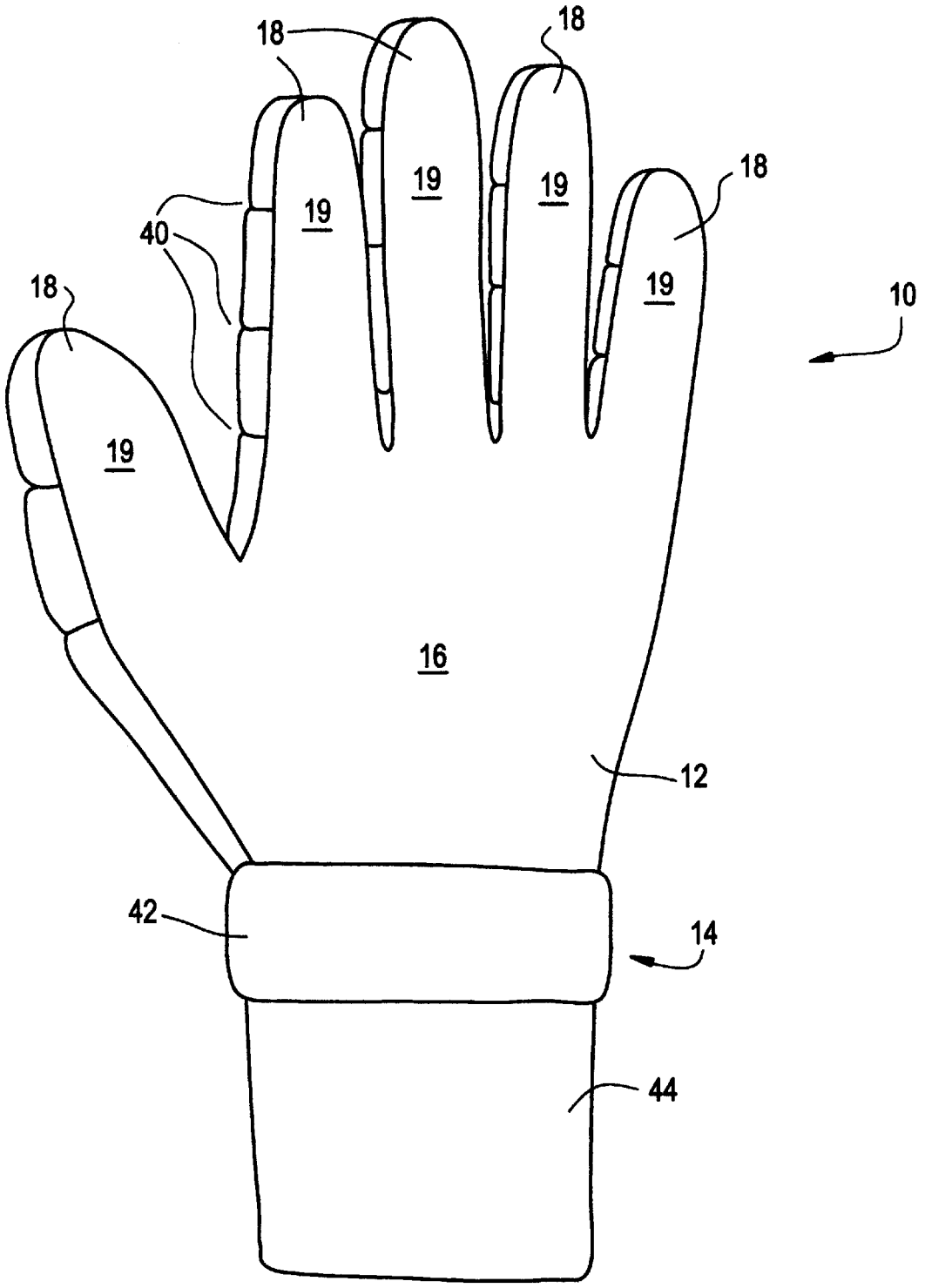
Figure 3:
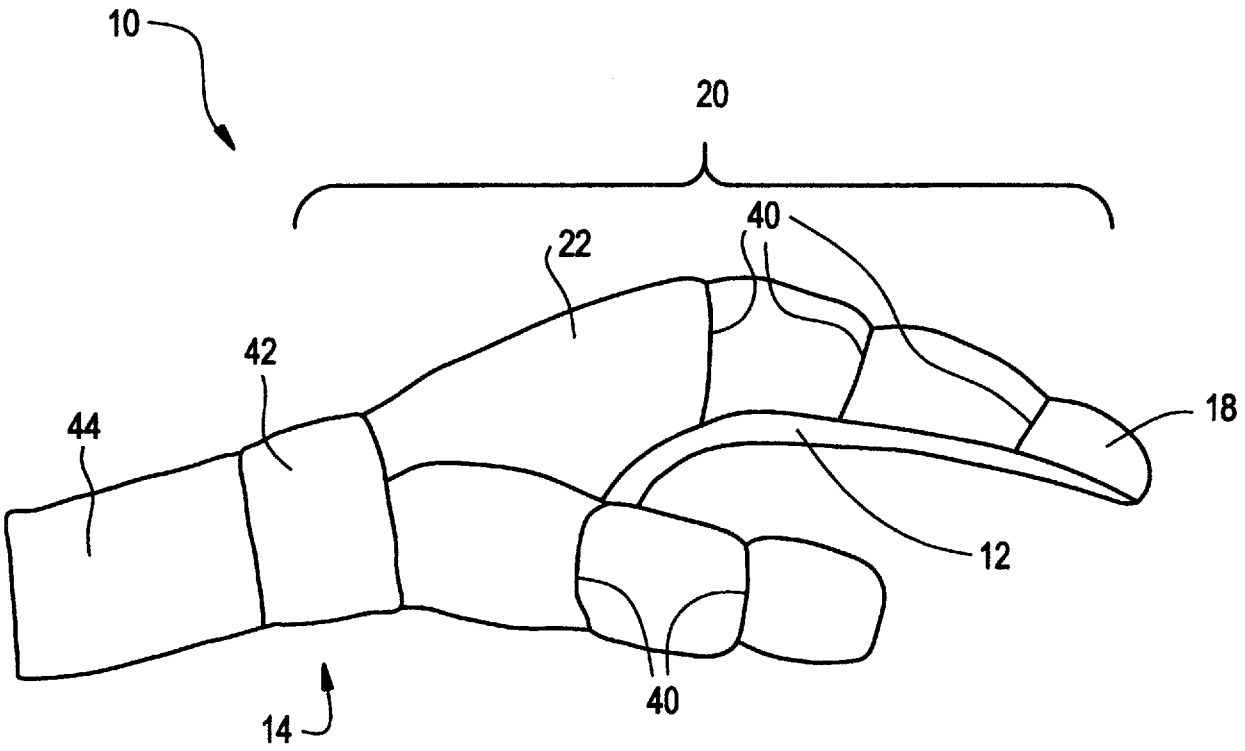

A wildland firefighting glove 10 according to the invention is shown in FIGS. 1–3. The glove includes a bottom portion 12 extending from the wrist region 14 forward so as to cover the entire palm region 16 of the hand and the bottom surfaces of the fingers 18, i.e., the surfaces of the fingers which curl inwardly when the hand is balled up into a fist. The glove also has a much thicker, heavily padded, highly protective upper portion 20 which extends over the back-of-the-hand region 22 and the upper surfaces of the fingers 18. Additionally, it is preferable for the upper portion 20 of the glove to wrap around the sides of the fingers.

Figure 1A:
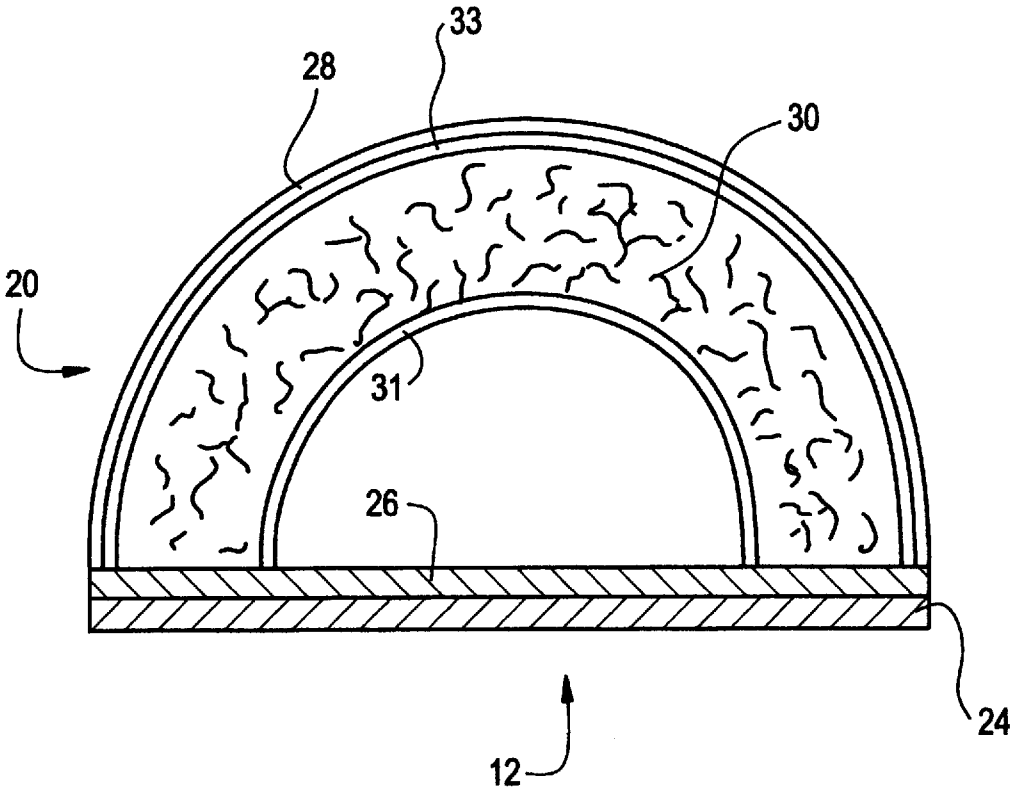
FIG. 1*a* is a section view along the lines 1*a*—1*a* in FIG. 1.

As shown in FIG. 1*a*, the bottom portion 12 is preferably formed from two relatively thin layers 24, 26. The outer layer 24 is preferably leather or other animal hide and is on the order of 1/16- to 1/8-inch thick. It may also be a synthetic material such as naugahyde or other similar fabric, as long as the material can stand up to exposure to heat and flame. The material should be relatively rugged. Such material at such thickness has sufficient flexibility to provide the firefighter with the dexterity required for fighting a wildland fire.

The inner layer 26 is a fire resistant insulating layer formed, e.g., from a Kevlar® knit material or from "space age" materials that have been developed by the aerospace industry to protect against extreme temperatures. One such "space age" material contemplated for use in gloves according to the invention is Gentex™ #1014 or #1025 aluminized fiberglass dual mirrored fabric. The liner 26 may be provided as a single layer on the inner surface of the outer layer 24, as shown in FIG. 1*a*, or by means of an insertable liner glove that fits within the glove cavity (a configuration not shown).

Figure 4:
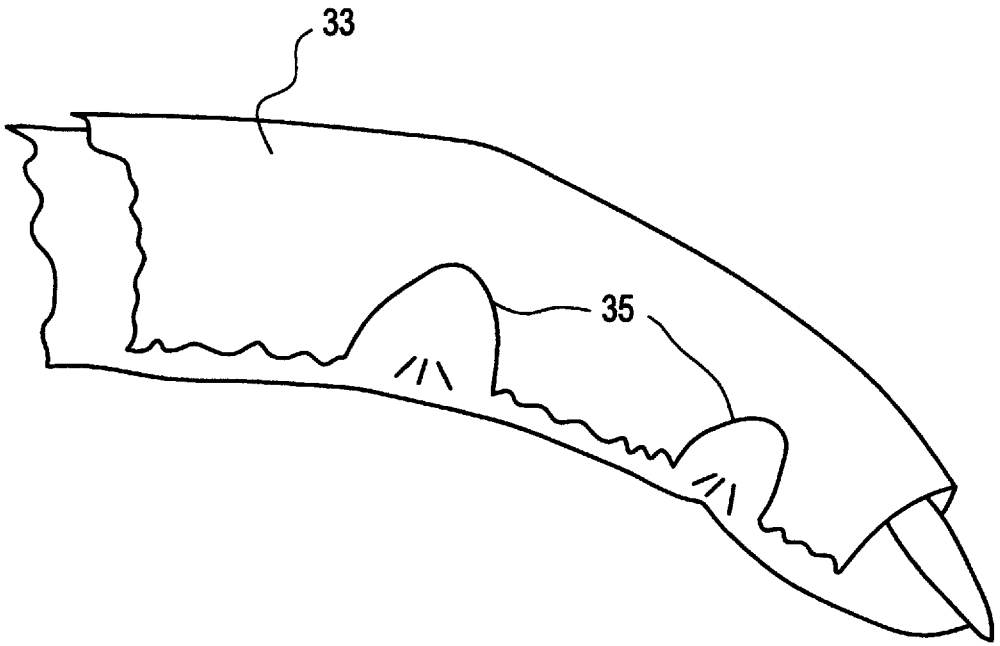
FIG. 4 is a side view showing an internal fire resistant, insulative layer in relation to a firefighter's finger.

The top portion 20 of the glove is formed from a shell 28 of fire resistant material, e.g., Advance®; a 60/40 blend of Kevlar® and Nomex® available from Southern Mills, Inc. in Union City Georgia, or a blend of Kevlar® and Hoechst-Celanese Corp. PBI®, and approximately 1/4- to 1/2-inch of insulating padding or "batting" 30 formed from fibrous, fire resistant material, e.g., Aralite™, available from Southern Mills, Inc. which consists of a layer of quilted Nomex® batting joined to a layer of woven Nomex®. For purposes of the present invention, the woven layer 31 of Nomex® should be disposed closer to the firefighter's fingers than the quilted batting. Additionally, it is preferable for the upper portion to include an inner layer 33 of fire resistant, insulative material, e.g., Gentex™ aluminized fiberglass dual mirrored fabric, that is located between the shell 28 and the padding 30. (When using aluminized fiberglass dual mirrored fabric, the metallized layer should face toward the top of the glove, i.e., away from the back of the hand so as to reflect heat. Moreover, to facilitate manual dexterity, the material, which can be relatively stiff, should have lateral indentations 35 in the joint regions, as shown in FIG. 4.) Finally, although FIG. 1*a* is a section view taken through one of the fingers of the glove, the thumb of the glove and the main, "body portion" of the glove (i.e., the portion of the glove surrounding the palm of the hand and the back of the hand) would all be of similar construction.

As noted above, a large range of manual dexterity is required when fighting a wildland fire. To ensure the requisite dexterity, the upper portion of the glove has joints 40 that allow the fingers to flex. The joints are formed in accordion-fold fashion, similar to the finger joints in a hockey glove. Alternatively, the joints can be formed by stitching the fingers of the glove into a longitudinally curved configuration.

A wildland firefighting glove 10 according to the invention also preferably has a padded wrist cuff 42. The wrist cuff 42 is constructed similarly to the upper portion of the glove, i.e., it has an outer shell formed from resistant material and a layer of fibrous, insulating padding or "batting" that is fire resistant and on the order of 1/4- to 1/2-inch thick, similar to the construction shown in FIG. 1*a*.

Finally, a wildland firefighting glove according to the invention also preferably has a wrist gauntlet 44, i.e., an extended cuff, extending from the padded wrist cuff 42 towards the elbow, approximately one third of the way from the wrist to the elbow. The gauntlet is preferably made from a stretchable, fire resistant material such as DuPont Nomex® or Hoechst-Celanese PBI®/DuPont Kevlar®, as is known in the art.

Other embodiments will occur to those having skill in the art and are deemed to be within the scope of the following claims.

What is claimed:

1. A protective glove for use in wildland fires, said glove comprising:

a bottom portion shaped to extend along a palm and bottom finger surfaces of a hand, said bottom portion comprising a protective layer permitting flexibility in hand movement, and an upper portion shaped to extend along the palm and upper finger surface of the hand, said upper layer comprising an outer shell of fire resistant material, an insulating batting layer formed of fibrous, fire resistant material, said batting layer being joined to a woven layer adjacent the hand.

2. A glove according to claim 1 wherein said upper portion covers sides of the fingers and the hands.

3. A glove according to claim 2 wherein said bottom portion comprises an inner fire resistant insulating layer portion and an outer rugged layer.

4. A glove according to claim 3 wherein said inner fire resistant layer comprises a single layer formed on a inner surface of said outer rugged layer.

5. A glove according to claim 2 wherein said batting is quilted.

6. A glove according to claim 2 further comprising a wrist cuff having an outer shell of fire resistant material, an insulating batting layer formed of fibrous, fire resistant material, said batting layer being joined to a woven layer adjacent the wrist.

7. A glove according to claim 6 further comprising a wrist gauntlet extending from said wrist cuff toward an elbow and comprising fire resistant material.

8. A glove according to claim 2 wherein said upper portion further comprises an inner fire resistant layer intermediate said outer shell and said insulating layer.

9. A glove according to claim 8 wherein said inner fire resistant layer comprises aluminized fiberglass mirrored fabric having a metallized layer facing said outer shell.

10. A glove according to claim 9 wherein said inner fire resistant layer comprises lateral indentations in the portions surrounding the sides of the fingers in the vicinity of each knuckle joint.

11. A glove according to claim 2 further comprising flex joints formed on said outer shell in the vicinity of each knuckle.

12. A glove according to claim 11 wherein said joints comprise accordion folds.

13. A glove according to claim 11 wherein said flex joints are formed by stitching in the vicinity of each knuckle.

14. A glove according to claim 9 wherein said inner fire resistant layer comprises lateral cut-outs in the portions surrounding the sides of the fingers in the vicinity of each knuckle joint.

* * * * *